US008561881B2

(12) United States Patent
Oboshi

(10) Patent No.: US 8,561,881 B2
(45) Date of Patent: Oct. 22, 2013

(54) DEVELOPED OBJECT FOR BUILDING PACKING BOX AND THE PACKING BOX

(75) Inventor: Junichiro Oboshi, Higashiosaka (JP)

(73) Assignee: Nippon Seisen Co., Ltd., Osaka (JP)

( * ) Notice: Subject to any disclaimer, the term of this patent is extended or adjusted under 35 U.S.C. 154(b) by 243 days.

(21) Appl. No.: 13/151,908

(22) Filed: Jun. 2, 2011

(65) Prior Publication Data

US 2012/0111932 A1 May 10, 2012

(30) Foreign Application Priority Data

Nov. 8, 2010 (JP) ..... 2010-249773

(51) Int. Cl.
*B65D 5/66* (2006.01)

(52) U.S. Cl.
USPC ..... 229/131.1; 229/138; 229/185.1

(58) Field of Classification Search
USPC ..... 229/126, 131.1, 138, 185.1, 193
See application file for complete search history.

(56) References Cited

U.S. PATENT DOCUMENTS 925,535 A * 6/1909 Tyson ..... 229/131.1
1,443,279 A * 1/1923 Schindler ..... 229/131.1
3,286,900 A * 11/1966 Keith ..... 229/138
3,581,977 A * 6/1971 Kirsky et al. ..... 229/138
5,007,580 A * 4/1991 Morrison et al. ..... 229/193
5,356,022 A * 10/1994 Tipps ..... 229/131.1
5,860,555 A * 1/1999 Mayled ..... 229/131.1

FOREIGN PATENT DOCUMENTS

JP 2006-51958 A 2/2006

* cited by examiner

*Primary Examiner* — Gary Elkins
(74) *Attorney, Agent, or Firm* — Birch, Stewart, Kolasch & Birch, LLP

(57) ABSTRACT

There is provided a packing box having a taking-out opening which can be opened with ease with only one hand. The developed object of packing box comprises: first strip foldable inwardly on fold lines arranged equidistantly and perpendicularly to strip lengthwise direction, for forming inner-lateral surface; second strip including three separate square bottom-boards continuous with first strip via fold lines; third strip continuous with central bottom-board via fold line and foldable inwardly on fold lines arranged equidistantly, for forming outer-lateral surface; and fourth strip continuous with third strip via fold line, in which buckling portions and upper lids are arranged alternately in lengthwise direction. Central buckling portion has square hole, and the width of the lid is larger than one-half of one side of bottom-board. One of the lids has a lid-cutting line formed in location that corresponds to square hole when one lid is inserted under the other.

2 Claims, 9 Drawing Sheets

DEVELOPED OBJECT FOR BUILDING PACKING BOX AND THE PACKING BOX

TECHNICAL FIELD

The present invention relates to a packing box for packaging a large quantity of articles such as nails and bolts.

BACKGROUND ART

In general, nails for use in construction of residential buildings, and bolts, nuts, rivets, and so forth for use in construction of steel-framed buildings as well as plants are put together on a predetermined weight (number) basis for carrying without any difficulty, and then placed in a cardboard-built box or a resin-made box for sale on the market. In contrast to the resin packing box which has to be stored as it is, viz., in the form of a cubic box, the corrugated cardboard packing box has a board-like shape in a yet-to-be-built condition and therefore occupies less space for storage than does the resin packing box, and is also inexpensive in unit price, with a consequent advantage in convenience.

The types of corrugated cardboard boxes are specified in JIS Z 1507, each of which is assigned a code number and illustrated in a developed view and a cubic view. In the marketplace, the types of corrugated cardboard boxes are popularly known as "A-type", "B-type", "C-type", etc., rather than being referred to as the code numbers defined in JIS. Moreover, corrugated cardboard boxes for packaging articles such as nails are generally put in the category of the A-type (orange carton type). A corrugated cardboard box of this type is formed with lid portions (flaps), each of which covers one-half of the top of the box in an opened state. The lid portion merges with the upper edge of each of two opposed lateral surfaces of the box. The lid portions are bent inwardly in a confronting state from the part of merging so as to close the opened top, and an adhesive tape such as a packing tape or kraft tape is placed at the confronting areas for completion of box building.

In a case where a large quantity of articles, such as nails and bolts, having the same dimension are used at a construction site and so forth, they are directly taken out of a packing box for use at the location of construction work. However, in most cases, a day's work is finished with some of the packed articles left unused. Therefore, in the condition of use as mentioned above, the packing box has to be stored while being left opened. In addition to the A-type, there are known "B-type" and "C-type". A corrugated cardboard box of the B-type is formed with a single lid, one edge of which merges with one of lateral surfaces of the box, and the other edge opposite the edge at the part of merging is folded over to form a flap for insertion, thereby closing the top of the box in an opened state. The box of this type can be lidded over and over again even after the box is opened. On the other hand, a corrugated cardboard box of the C-type is composed of two separate parts, namely a main body having four lateral surfaces and a bottom surface, and a lid. However, in both of the B-type and the C-type, it is difficult for the lid to be held securely in place so that the box can withstand handling during, e.g. transportation while having heavy articles such as nails packaged therein. Furthermore, there is the possibility that the lid fails to serve the purpose properly after the box is opened due to box deformation caused by heavy articles such as nails housed therein. As another drawback, a corrugated cardboard box of the B-type as well as the C-type has a large opened area and is therefore prone to intrusion of water in the event of sudden rainfall.

Although target articles to be packaged are unknown, in Patent Literature 1, there is disclosed a technology related to a corrugated cardboard box characterized in that it can be sealed over and over again even after opening and that the opened area of the box in an opened state is smaller than the area of the top of the box. In the corrugated cardboard box disclosed in Patent Literature 1, lid portions (outer flaps) that merge with two opposed edges on the top of the box, respectively, overlap each other at their ends on the top, thereby rendering possible re-sealing of the box. An opening for taking out box content is provided in the form of a gap between inner flaps lying inside the lid portions.

PRIOR ART REFERENCE

Patent Literature

[Patent Literature 1] Japanese Unexamined Patent Publication JP-A 2006-51958

SUMMARY OF THE INVENTION

Problems to be Solved by the Invention

The corrugated cardboard box disclosed in Patent Literature 1 is excellent in that the taking-out opening can be closed over and over again even after the box is opened. However, during the time the box is opened, the side flap having an area greater than or equal to the opened area of the top needs to be folded outwardly of the box. In this case, for example, in a construction site with scaffolding lacking in stability, the workability will be deteriorated. Furthermore, the taking-out opening cannot be opened and closed with ease with one hand, with a consequent inconvenience of repeating opening and re-sealing operations every time box content is taken out.

The present invention has been devised in view of the problems as mentioned supra, and an object of the present invention is to provide a packing box having a taking-out opening which can be opened and closed repeatedly with ease with only one hand, and a developed object for building the packing box.

Means for Solving the Problems

The developed object for building a packing box pursuant to the present invention is a developed object for building a packing box formed by processing a board material. The developed object is composed of four segments extending in the same direction, namely a first strip segment, a second strip segment, a third strip segment, and a fourth strip segment. The first strip segment comprises: a middle-bottom board inner portion, a lower-bottom board inner portion, and an upper-bottom board inner portion that have substantially the same length in an extending direction in which the segment extends, and are continuous with one another via fold lines in the extending direction; and a first inner portion and a second inner portion that are continuous with the middle-bottom board inner portion and the upper-bottom board inner portion, respectively, at the outsides thereof via fold lines in the extending direction, the lengths of which being substantially the same as one-half of the length of the middle-bottom board inner portion in the extending direction, or a terminal inner portion which is continuous with one of the middle-bottom board inner portion and the upper-bottom board inner portion at the outside thereof via a fold line in the extending direction, the length of which being substantially the same as the length of the middle-bottom board inner portion in the extending direction. The second strip segment comprises three portions, namely a middle-bottom board portion, a lower-bottom board portion, and an upper-bottom board portion that are continuous with the middle-bottom board inner portion, the lower-bottom board inner portion, and the upper-bottom board inner portion, respectively, via fold lines conforming to their respective one sides in the extending direction, are each given substantially the shape of a square, one side of which conforming to the fold line, and are separated from one another at their sides other than the one sides conforming to the continuous fold lines. The third strip segment which has substantially the same entire width as that of the first strip segment and is situated on an opposite side from the first strip segment with the second strip segment lying therebetween, comprises: a lower-bottom board outer portion which is continuous only with the lower-bottom board portion via a fold line; a middle-bottom board outer portion and an upper-bottom board outer portion that lie on both sides of the lower-bottom board outer portion in the extending direction, are each continuous with the lower-bottom board outer portion via a fold line, and have substantially the same length as that of the lower-bottom board outer portion in the extending direction; and a first outer portion and a second outer portion that are continuous with the middle-bottom board outer portion and the upper-bottom board outer portion, respectively, at the outsides thereof via fold lines in the extending direction, the lengths of which being substantially the same as one-half of the length of the middle-bottom board outer portion in the extending direction, or a terminal outer portion which is continuous with one of the middle-bottom board outer portion and the upper-bottom board outer portion at the outside thereof via a fold line in the extending direction, the length of which being substantially the same as the length of the middle-bottom board outer portion in the extending direction. The fourth strip segment which is situated on an opposite side from the second strip segment with the third strip segment lying therebetween, comprises: a central buckling portion which is continuous with the lower-bottom board outer portion via a fold line, the width of which being substantially the same as one-half of one side of the lower-bottom board portion; a first lid portion and a second lid portion that lie on both sides of the central buckling portion in the extending direction, are each continuous with the central buckling portion via a fold line, are continuous with the middle-bottom board outer portion and the upper-bottom board outer portion, respectively, via fold lines, the widths of which being larger than or equal to one-half of one side of the lower-bottom board portion; and, where the third strip segment includes the first outer portion and the second outer portion, a first buckling portion which is continuous with the first lid portion and the first outer portion via fold lines, the width of which being substantially the same as that of the central buckling portion and the length of which being substantially the same as that of the first outer portion in the extending direction, and a second buckling portion which is continuous with the second lid portion and the second outer portion via fold lines, the width of which being substantially the same as that of the central buckling portion and the length of which being substantially the same as that of the second outer portion in the extending direction, or, where the third strip segment includes the terminal outer portion, a terminal buckling portion which is continuous with the second lid portion and the terminal outer portion via fold lines, the width of which being substantially the same as that of the central buckling portion and the length of which being substantially the same as that of the terminal outer portion in the extending direction. The central buckling portion is formed with a first inclined fold line extending outwardly from a point of intersection of the fold lines merging with the first lid portion and the lower-bottom board outer portion, respectively, at an inclination angle of 45 degrees with respect to the fold lines, and a second inclined fold line extending outwardly from a point of intersection of the fold lines merging with the second lid portion and the lower-bottom board outer portion, respectively, at an inclination angle of 45 degrees with respect to the fold lines. The first buckling portion is formed with a fourth inclined fold line extending outwardly from a point of intersection of the fold lines merging with the first outer portion and the first lid portion, respectively, at an inclination angle of 45 degrees with respect to the fold lines. The second buckling portion is formed with a third inclined fold line extending outwardly from a point of intersection of the fold lines merging with the second outer portion and the second lid portion, respectively, at an inclination angle of 45 degrees with respect to the fold lines. The terminal buckling portion is formed with a third inclined fold line extending outwardly from a point of intersection of the fold lines merging with the terminal outer portion and the second lid portion, respectively, at an inclination angle of 45 degrees with respect to the fold lines, and a fourth inclined fold line which is orthogonal to the third inclined fold line at an edge of the terminal buckling portion opposite from the terminal outer portion-sided edge thereof, and extends therefrom toward the terminal outer portion. The central buckling portion is formed with a nearly-square hole or a nearly-square cutaway, a diagonal line of which conforming to the second inclined fold line. The second buckling portion has, where the cutaway is provided in the central buckling portion, a terminal cutaway formed at an outer edge thereof in the extending direction, a diagonal line of which conforming to the third inclined fold line. The second lid portion is formed with a cutting line for lid for forming an opening and closing lid whose turning axis conforms to the fold line between the second lid portion and the upper-bottom board outer portion by cutting. The cutting line for lid is located in an area that corresponds to the hole or the cutaway when the second lid portion is folded over the central buckling portion on the fold line merging with the central buckling portion.

The fold lines are provided in the board material for easy folding of the board material on the fold lines. The first to fourth fold lines differ in bending direction from other fold lines. For example, the first to fourth fold lines are so configured as to be bendable rearward at its opposite sides, whereas the other fold lines are so configured as to be bendable frontward at its opposite sides.

The packing box pursuant to the present invention comprises: a nearly-square bottom formed of the middle-bottom board portion, the lower-bottom board portion, and the upper-bottom board portion of the second strip segment that are stacked on top of one another; an inner lateral surface perpendicular to the bottom, which is formed of the first strip segment; an outer lateral surface surrounding the inner lateral surface, which is formed of the third strip segment; and a top which is closed by folding the central buckling portion, the first lid portion, the second lid portion, the first buckling portion, and the second buckling portion of the fourth strip segment on their respective fold lines face to face with the bottom, and inserting an edge of the second lid portion opposite from the upper-bottom board outer portion-sided edge thereof under an edge of the first lid portion.

Advantages of the Invention

According to the present invention, there is provided a packing box having a taking-out opening which can be opened and closed repeatedly with ease with only one hand.

MODES FOR CARRYING OUT THE INVENTION

Figure 1:
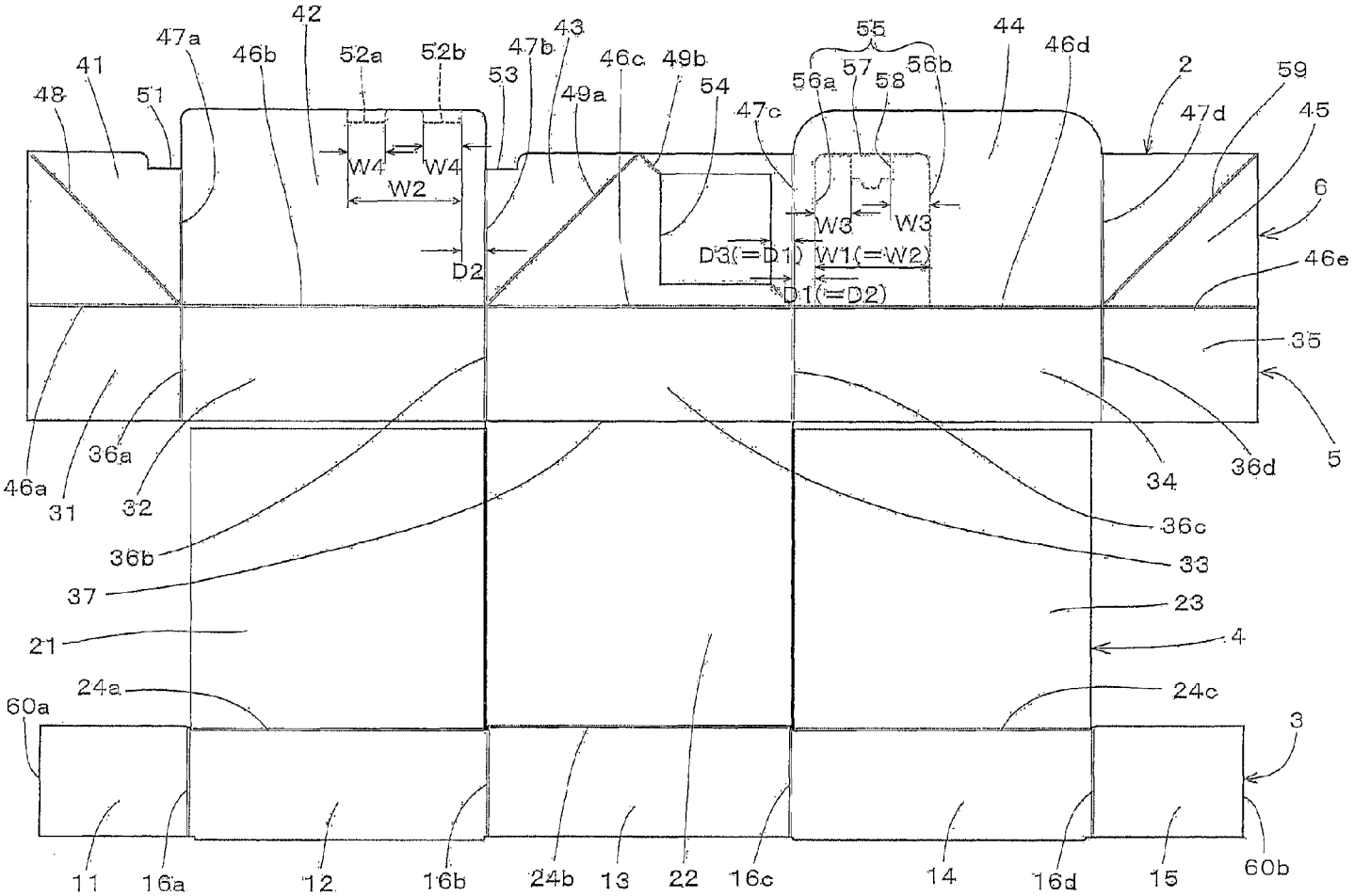
FIG. 1 is a developed view of a packing box.
Figure 6:
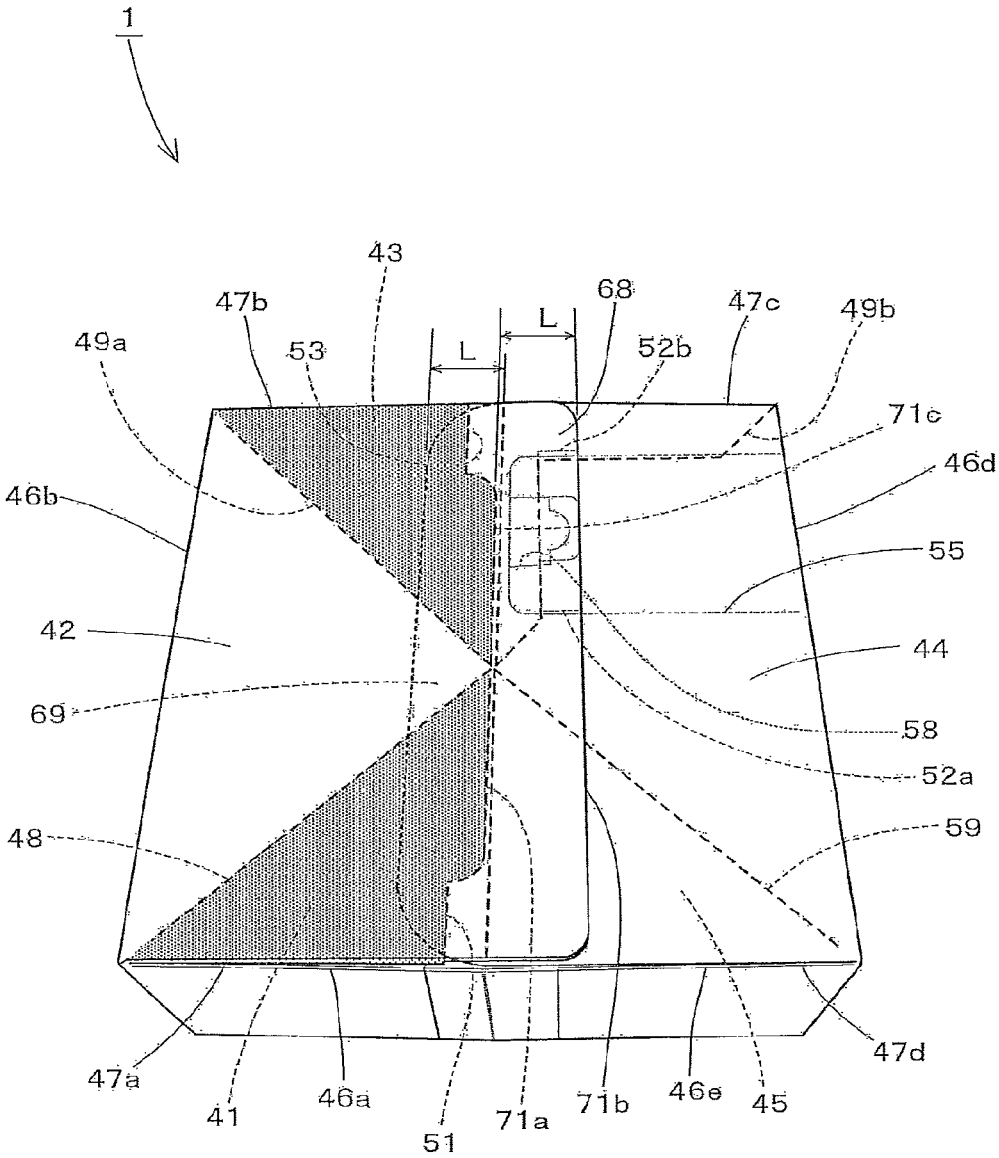
FIG. 6 is a perspective view showing the packing box in finished form.
Figure 7:
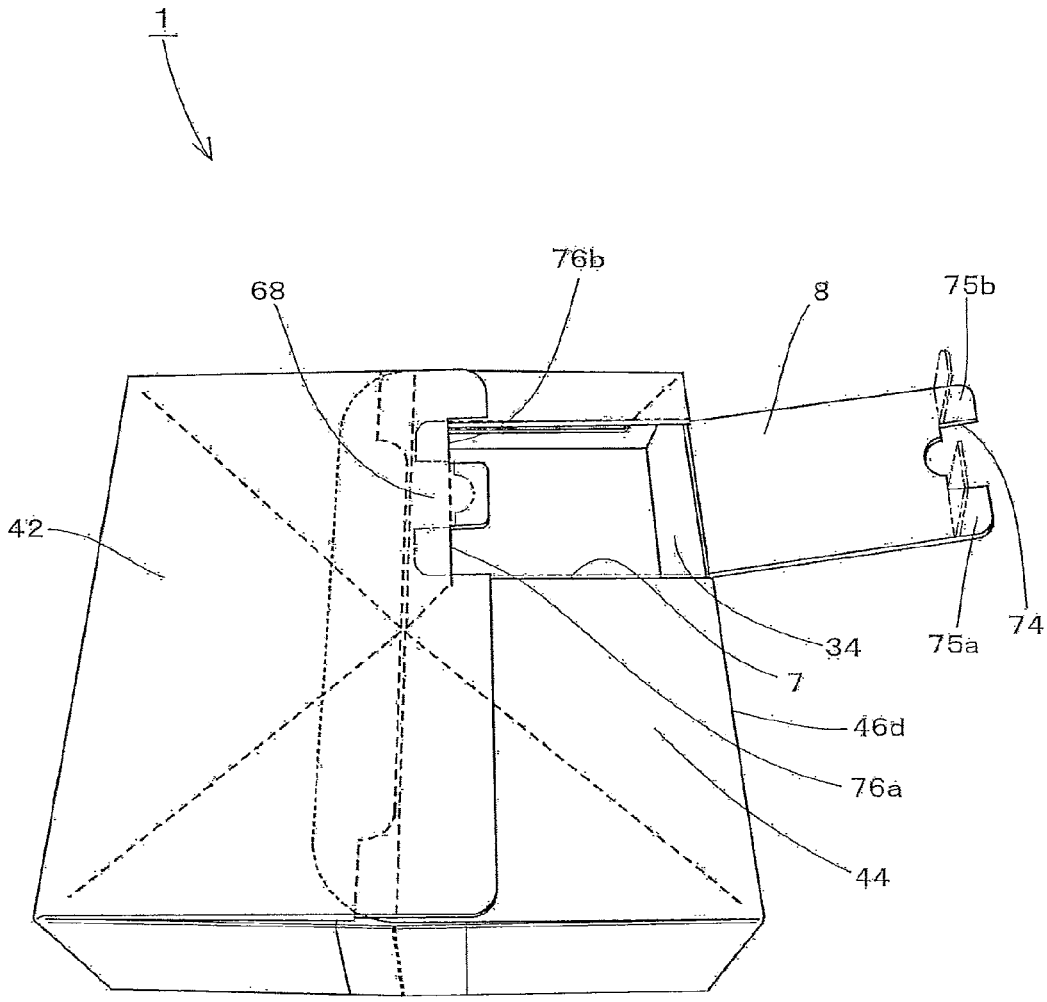
FIG. 7 is a perspective view showing the packing box with its taking-out opening kept opened.

FIG. 1 is a developed view of a packing box 1. FIGS. 2 to 5 are perspective views showing the packing box 1 in the middle of building. FIG. 6 is a perspective view showing the packing box 1 in finished form. FIG. 7 is a perspective view showing the packing box 1 with its taking-out opening 7 kept opened. The packing box 1 is formed by building a developed object 2 as shown in FIG. 1. The developed object 2 is formed by cutting a board material such as a paper corrugated cardboard, a plastic carton, or other equivalent paper or plastic material, followed by forming fold lines thereon.

A rectangular board material is used for the formation of the developed object 2. The developed object 2 is four-segmented, each strip-like segment extending in the direction of length of the board material. In FIG. 1, the lowermost strip-like segment (hereafter referred to as "the first strip segment 3") is subdivided, from one side (the left side) to the other, into a first inner portion 11, a middle-bottom board inner portion 12, a lower-bottom board inner portion 13, an upper-bottom board inner portion 14, and a second inner portion 15 by fold lines 16*a*, 16*b*, 16*c*, and 16*d* that are perpendicular to the lengthwise direction. Each of the fold lines 16*a*, 16*b*, 16*c*, and 16*d* is so configured as to be bendable frontward at its, opposite sides, as viewed in FIG. 1.

In this description, the term"lengthwise direction" refers to the direction of length of the board material. The middle-bottom board inner portion 12, the lower-bottom board inner portion 13, and the upper-bottom board inner portion 14 have substantially the same length in the lengthwise direction. The first inner portion 11 and the second inner portion 15 are substantially half the length of the middle-bottom board inner portion 12 and others in the lengthwise direction. The first inner portion 11, the middle-bottom board inner portion 12, the lower-bottom board inner portion 13, the upper-bottom board inner portion 14, and the second inner portion 15 have substantially the same width (dimension in a direction perpendicular to the lengthwise direction). The width of the first inner portion 11 and others conforms to the height of the packing box 1.

As to the explanation of the developed object 2, the constituent portions concerned are illustrated as having substantially the same length in comparison. The board material has a certain thickness in reality, and the portions need to overlap each other for the building of the packing box 1 which will hereafter be described. In consideration whereof, if the portions are configured to have exactly the same dimension, some part may become a hindrance to proper box building. Thus, the expression "substantially the same" which has already appeared in the foregoing description and will appear in the following description means that the portions have the same dimension in principle, but embraces a case where the portions differ slightly in dimension from each other with consideration given to the thickness of the board material so that no trouble will be caused when the portions overlap each other.

In FIG. 1, a strip-like segment located above the first strip segment 3 (hereafter referred to as "the second strip segment 4") is composed of three adjacent portions, namely a middle-bottom board portion 21, a lower-bottom board portion 22, and an upper-bottom board portion 23 that are square-shaped and have substantially the same size. The middle-bottom board portion 21 is continuous only with the middle-bottom board inner portion 12 via a fold line 24*a*. The lower-bottom board portion 22 is located on the other side (right side) of the middle-bottom board portion 21 while being separated therefrom, and is continuous with the lower-bottom board inner portion 13 via a fold line 24*b*.

The upper-bottom board portion 23 is located on the other side (right side) of the lower-bottom board portion 22, and is continuous only with the upper-bottom board inner portion 14 via a fold line 24*c*. The middle-bottom board portion 21, the lower-bottom board portion 22, and the upper-bottom board portion 23 are substantially the same in length as the middle-bottom board inner portion 12 and others in the direction of length of the board material. The fold lines 24*a*, 24*b*, and 24*c* for providing connection between the first strip segment 3 and the second strip segment 4 are each configured so as to be bendable frontward at its opposite sides, as viewed in FIG. 1.

In FIG. 1, a strip-like segment located adjacently above the second strip segment 4 (hereafter referred to as "the third strip segment 5") is subdivided, from one side (the left side) to the other, into a first outer portion 31, a middle-bottom board outer portion 32, a lower-bottom board outer portion 33, an upper-bottom board outer portion 34, and a second outer portion 35. Two adjacent ones out of the first outer portion 31, the middle-bottom board outer portion 32, the lower-bottom board outer portion 33, the upper-bottom board outer portion 34, and the second outer portion 35 are continuous with each other via a fold line 36*a*, 36*b*, 36*c*, 36*d* extending perpendicularly to the direction of length of the board material so as to be bendable frontward, as viewed in FIG. 1.

The middle-bottom board outer portion 32, the lower-bottom board outer portion 33, and the upper-bottom board outer portion 34 have substantially the same length in the direction of length of the board material. The length of these portions is set to be somewhat larger than the length of the middle-bottom board inner portion 12 and others, with consideration given to the thickness of the board material. The first outer portion 31 and the second outer portion 35 are substantially half the length of the middle-bottom board outer portion 32 in the direction of length of the board material. The first outer portion 31, the middle-bottom board outer portion 32, the lower-bottom board outer portion 33, the upper-bottom board outer portion 34, and the second outer portion 35 have substantially the same width (dimension in the direction perpendicular to the lengthwise direction).

The middle-bottom board outer portion 32 and the upper-bottom board outer portion 34 are arranged next to the middle-bottom board portion 21 and the upper-bottom board portion 23, respectively, with a slight gap lying between them, in the direction perpendicular to the lengthwise direction. The lower-bottom board outer portion 33 is continuous with the lower-bottom board portion 22 via a fold line 37 extending in the lengthwise direction. The fold line 37 is so configured as to be bendable frontward at its opposite sides, as viewed in FIG. 1. In FIG. 1, the uppermost strip-like segment (a strip-like segment located adjacently above the third strip segment 5, which will be referred to as "the fourth strip segment 6") is subdivided, from one side (the left side) to the other, into a first buckling portion 41, a first lid portion 42, a central buckling portion 43, a second lid portion 44, and a second buckling portion 45.

The first buckling portion 41 is nearly square in shape, and the length of each side of the square conforms to the length of the first outer portion 31 in the lengthwise direction. One of the sides of the square is continuous with the first outer portion 31 via a fold line 46*a* extending in the lengthwise direction. The first buckling portion 41 is continuous with the first lid portion 42 via a fold line 47*a* extending in the direction perpendicular to the lengthwise direction. The first buckling portion 41 is formed with a fold line 48 extending diagonally from a point of intersection of the fold line 46*a* and the fold line 47*a*. The fold line 46*a* and the fold line 47*a* are each configured so as to be bendable frontward at its opposite sides, as viewed in FIG. 1. The fold line 47*a* is a continuation of the fold line 36*a*. The fold line 48 is so configured as to be bendable rearward at its opposite sides, as viewed in FIG. 1.

The first buckling portion 41 has a first recess 51 of substantially rectangular shape formed at one top corner thereof that is away from the fold line 46*a* and is continuous with the first lid portion 42. The dimension of the first recess 51 in the lengthwise direction is about 20 percent of the length of a side of the square defining the first buckling portion 41, and the dimension thereof in the direction perpendicular to the lengthwise direction is about 10 percent of the length of a side of the square defining the first buckling portion 41. An edge of the first recess 51 is connected, through a curve (an arc defining a quarter of the circumference of a circle), to an edge of the first buckling portion 41 extending in the lengthwise direction.

The first lid portion 42 is substantially rectangular in shape and is, at its side opposite the side merging with the first buckling portion 41, continuous with the central buckling portion 43 via a fold line 47*b* which is a continuation of the fold line 36*b*. The first lid portion 42 is also continuous with the middle-bottom board outer portion 32 via a fold line 46*b* which is a continuation of the fold line 46*a*. The fold line 47*b* and the fold line 46*b* are each configured so as to be bendable frontward at its opposite sides, as viewed in FIG. 1. The first lid portion 42 is so configured that its dimension in the direction perpendicular to the lengthwise direction is about 65 percent of its dimension in the lengthwise direction.

The first lid portion 42 protrudes beyond the adjacent first buckling portion 41 and central buckling portion 43 in the direction perpendicular to the lengthwise direction. The two protruding top corners are curved (in the form of an arc defining a quarter of the circumference of a circle). The first lid portion 42 has formed at its protruding end located toward the central buckling portion 43 two perforated cutting lines 52*a* and 52*b* spaced apart in the lengthwise direction for easy formation of notches by hands afterwards, by which an area around the protruding end is divided into rectangular parts having substantially the same shape and size.

The central buckling portion 43 is, at its side opposite the side merging with the first lid portion 42, continuous with the second lid portion 44 via a fold line 47*c* which is a continuation of the fold line 36*c*. The central buckling portion 43 is also continuous with the lower-bottom board outer portion 33 via a fold line 46*c* which is a continuation of the fold line 46*b*. The fold line 47*c* and the fold line 46*c* are each configured so as to be bendable frontward at its opposite sides, as viewed in FIG. 1. The dimension of the central buckling portion 43 in the direction perpendicular to the lengthwise direction is substantially the same as the length of a side of the square defining the first buckling portion 41. An edge of the central buckling portion 43 nearest the first lid portion 42 is shaped into a second recess 53 of substantially rectangular shape. The second recess 53 is substantially identical in size and shape with the first recess 51 in an reversed state (the first recess 51 as viewed from the rear).

The central buckling portion 43 is formed with a fold line 49*a* and a fold line 49*b*. The fold line 49*a* extends from a point of intersection of the fold line 47*b* and the fold line 46*c*, at an inclination angle of 45 degrees, to the edge of the central buckling portion 43. The fold line 49*b* extends from a point of intersection of the fold line 47*c* and the fold line 46*c*, at an inclination angle of 45 degrees, to the edge of the central buckling portion 43. The fold line 49*a* and the fold line 49*b* intersect each other at the edge of the central buckling portion 43. The central buckling portion 43 has a square hole 54 formed in a part thereof located toward the second lid portion 44. The square hole 54, which is formed by punching the board material, has a diagonal line conforming to the fold line 49*b*.

The second lid portion 44 is, at its side opposite the side merging with the central buckling portion 43, continuous with the second buckling portion 45 via a fold line 47*d* which is a continuation of the fold line 36*d*. The second lid portion 44 is also continuous with the upper-bottom board outer portion 34 via a fold line 46*d* which is a continuation of the fold line 46*c*. The fold line 47*d* and the fold line 46*d* are each configured so as to be bendable frontward at its opposite sides, as viewed in FIG. 1. The dimension of the second lid portion 44 in the direction perpendicular to the lengthwise direction is substantially the same as the length of the first lid portion 42 in the direction perpendicular to the lengthwise direction. That is, the second lid portion 44 is so configured that its dimension in the direction perpendicular to the lengthwise direction is about 65 percent of its dimension in the lengthwise direction.

The second lid portion 44 protrudes beyond the adjacent central buckling portion 43 and second buckling portion 45 in the direction perpendicular to the lengthwise direction. The two protruding top corners are curved (in the form of an arc defining a quarter of the circumference of a circle). The second lid portion 44 has a perforated cutting line for lid 55 formed in an area thereof located toward the central buckling portion 43. The area surrounded by the cutting line for lid 55 can be cut readily by hands afterwards, thereby forming a taking-out opening lid 8.

The perforated cutting line for lid 55 is composed of two side lines 56*a* and 56*b*, an end line 57, and a concave line 58. The side lines 56*a* and 56*b* extend from the fold line 46*d* as a starting point to the position of extension of the edge of the central buckling portion 43. The side lines 56*a* and 56*b* are spaced apart in parallel with the fold line 47*c*. The end line 57 is a line which establishes connection between the extending ends of, respectively, the side lines 56*a* and 56*b*. The concave line 58 is a line which defines a rectangle, one side of which conforms to the mid portion of the end line 57, between the side lines 56*a* and 56*b*. The perforated rectangle can be cut away easily by human hands.

A spacing W1 between the side lines 56*a* and 56*b* is substantially the same as a dimension W2 which is the dimension of the region where the two cutting lines 52*a* and 52*b* are formed in the first lid portion 42 in the lengthwise direction. A distance D1 between the side line 56*a* located toward the central buckling portion 43 and the fold line 47*c* is substantially the same as a distance D2 between the cutting line 52*b* located toward the central buckling portion 43 and the fold line 47*b*. Moreover, the distance D1 is substantially the same as a distance D3 between the square hole 54 and the fold line 47*c*.

Distances W3, namely the distance W3 between the side line 56*a* and the area surrounded by the concave line 58 and the distance W3 between the side line 56*b* and said surrounded area are substantially the same. The distances W3 are each substantially the same as a dimension W4 which is the dimension of the rectangle defined by the cutting line 52*a*, 52*b* in the lengthwise direction. The second buckling portion 45 is continuous with the second outer portion 35 via a fold line 46*e* which is a continuation of the fold line 46*d*. The fold line 46*e* is so configured as to be bendable frontward at its opposite sides, as viewed in FIG. 1. The second buckling portion 45 is nearly square in shape, and two sides of the square intersecting at right angles conform to the fold line 47*d* and the fold line 46*e* having substantially the same length, respectively. The second buckling portion 45 has substantially the same size as that of the first buckling portion 41, with the assumption that the first recess 51 is not provided. The second buckling portion 45 is formed with a fold line 59 extending from a top corner defined by the fold line 47*d* and the fold line 46*e* to the diagonally opposite corner. The fold line 59 is so configured as to be bendable rearward at its opposite sides, as viewed in FIG. 1.

Figure 2:
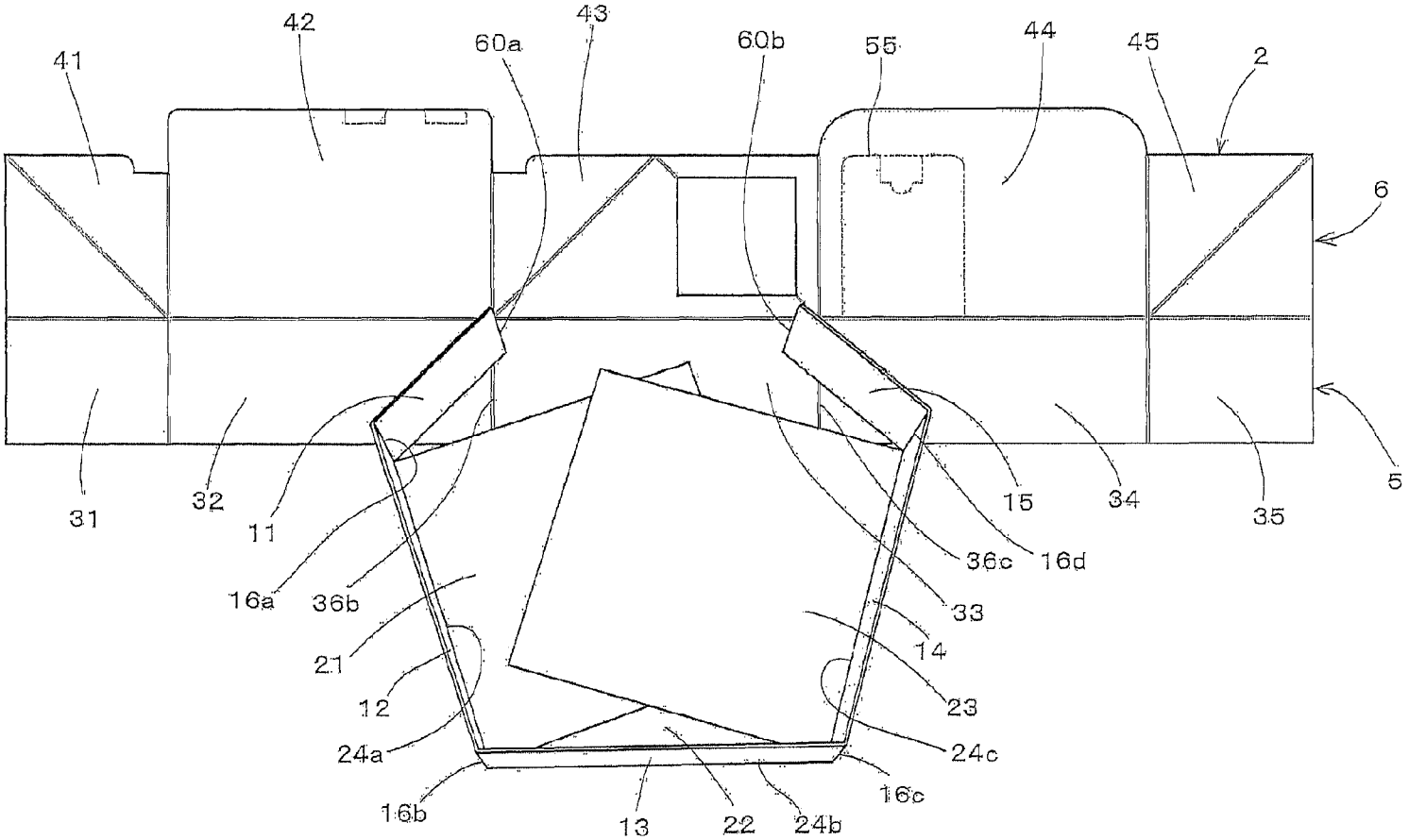
FIG. 2 is a perspective view showing the packing box in the middle of building.
Figure 3:
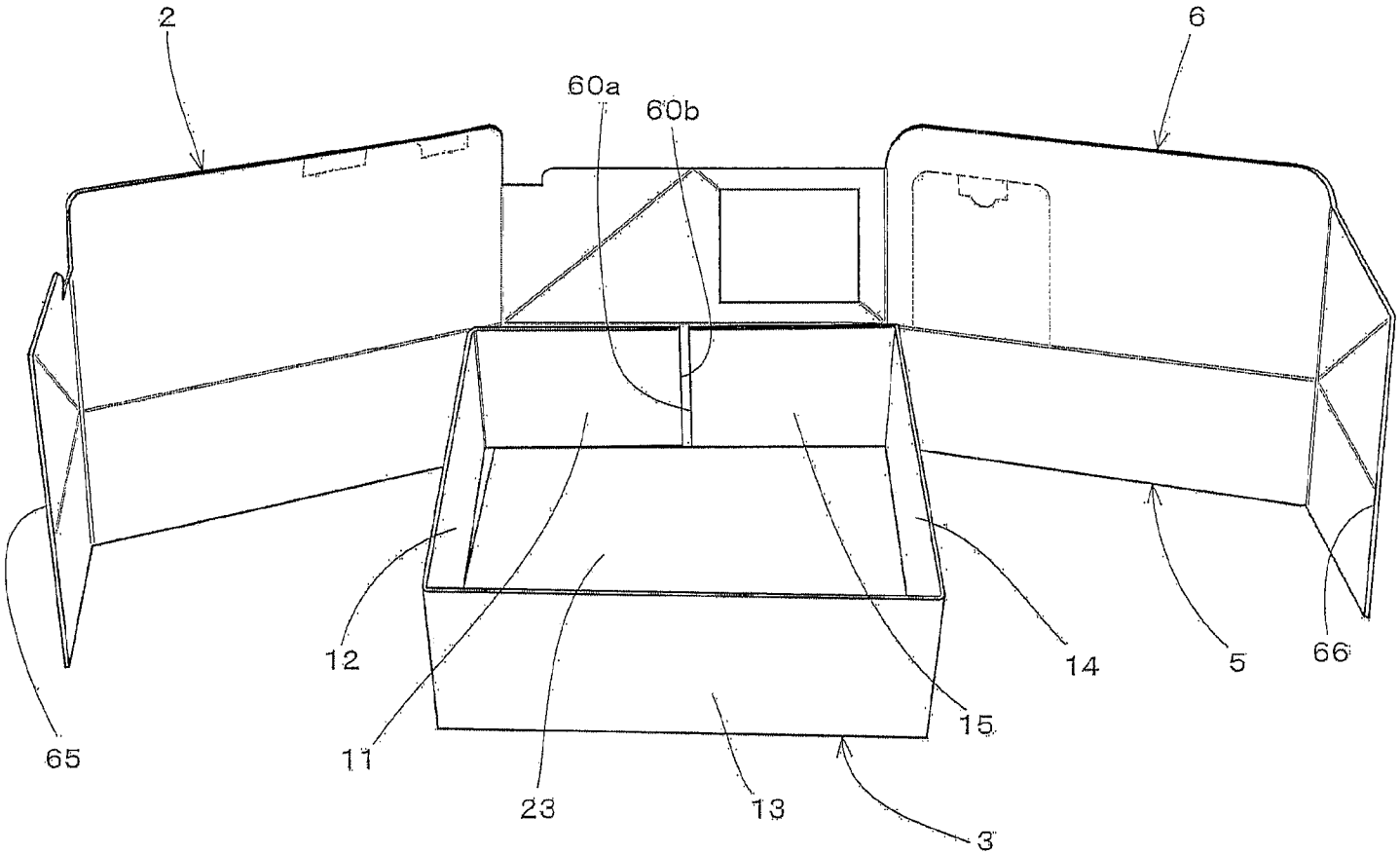
FIG. 3 is a perspective view showing the packing box in the middle of building.

Next, how the packing box 1 is to be built with use of the developed object 2 will be explained. Referring to FIGS. 2 and 3, the first strip segment 3 is folded about 90 degrees with respect to the second strip segment 4 on the fold lines 24*a*, 24*b*, and 24*c*. Then, in the first strip segment 3, the first inner portion 11, the middle-bottom board inner portion 12, the lower-bottom board inner portion 13, the upper-bottom board inner portion 14, and the second inner portion 15 are folded about 90 degrees with respect to their respective adjacent portions on the fold lines 16*a*, 16*b*, 16*c*, and 16*d*, respectively. Important points that must be taken when folding the portions on the fold lines 16*a*, 16*b*, 16*c*, and 16*d* are that the middle-bottom board portion 21 is put over the lower-bottom board portion 22, and the upper-bottom board portion 23 is then put over the middle-bottom board portion 21.

Figure 4:
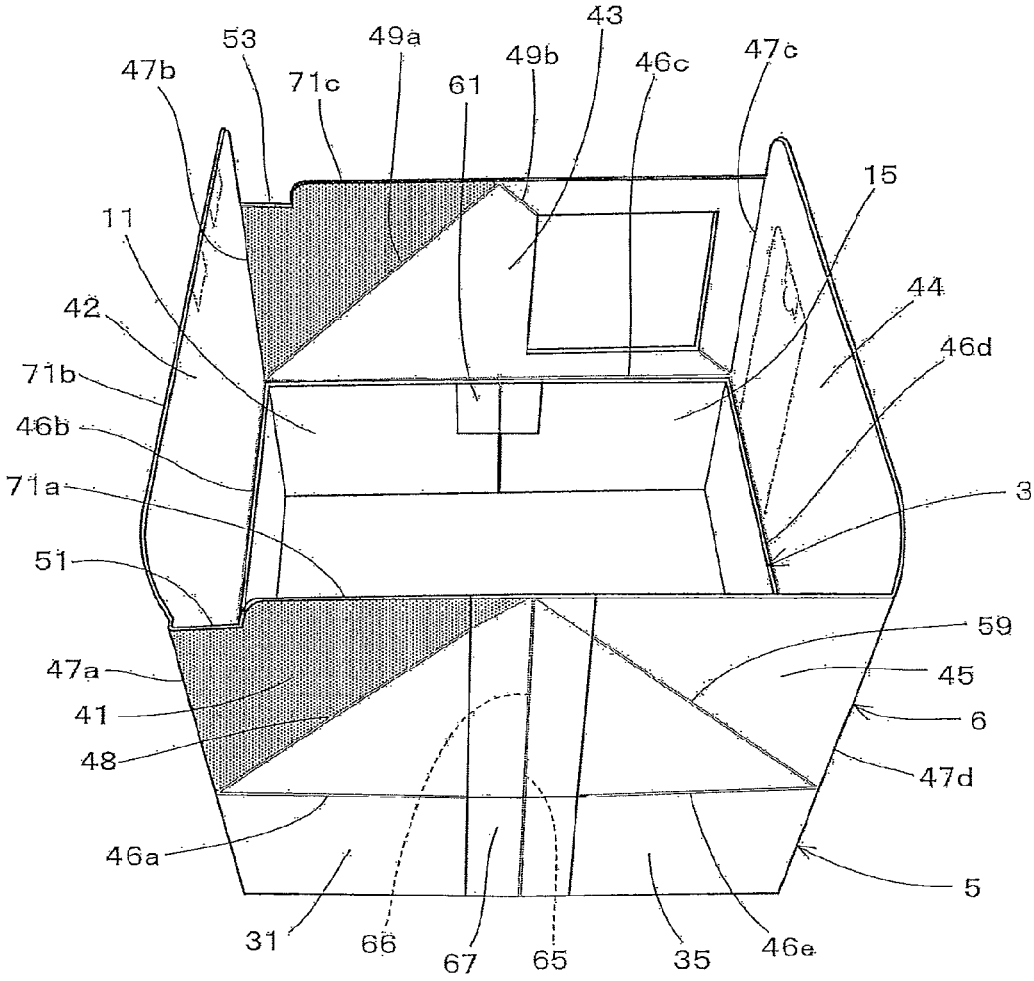
FIG. 4 is a perspective view showing the packing box in the middle of building.
Figure 5:
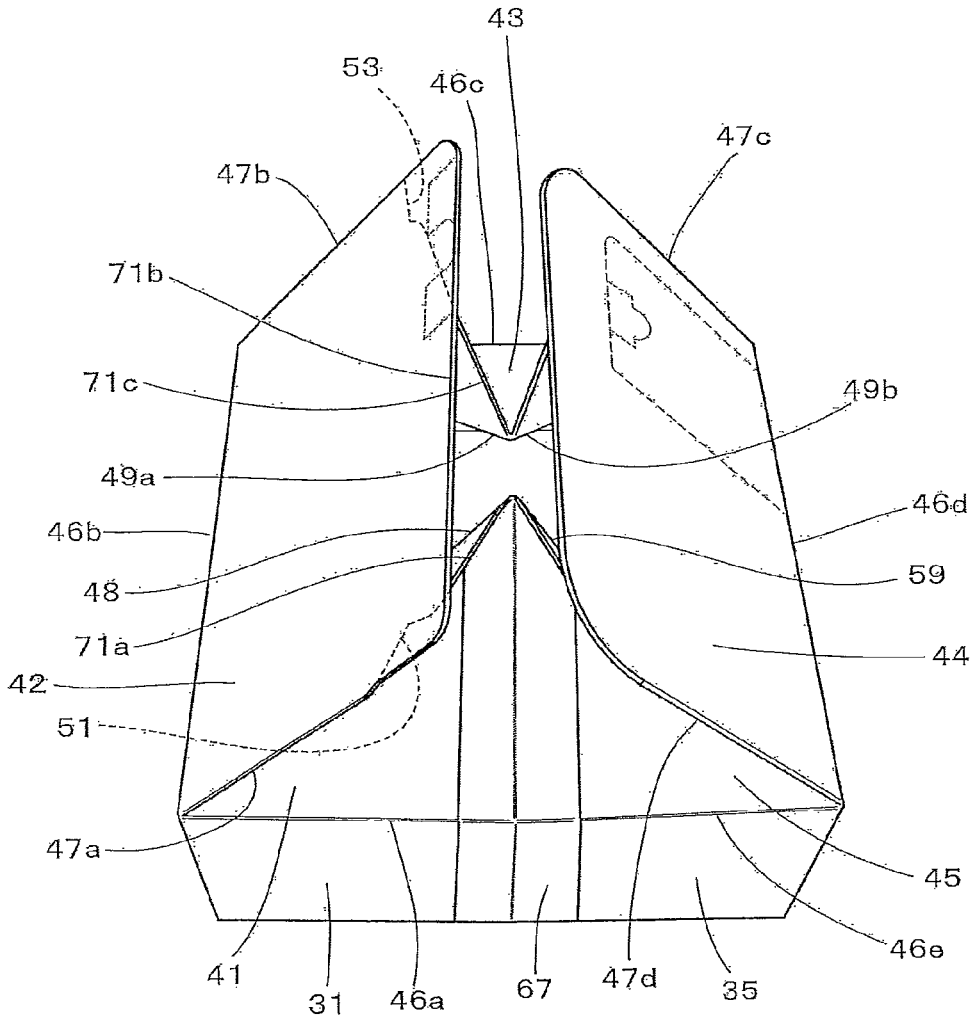
FIG. 5 is a perspective view showing the packing box in the middle of building.

When the lower-bottom board portion 22, the middle-bottom board portion 21, and the upper-bottom board portion 23 are stacked on top of one another with the sides of their respective square shapes kept aligned, then an edge 60*a* at the front end of the first inner portion 11 and an edge 60*b* at the front end of the second inner portion 15 confront each other. These portions are connected together at their front ends by an adhesive tape 61 (refer to FIG. 4). Referring to FIGS. 3 and 4, the third strip segment 5 and the fourth strip segment 6 are folded on the fold line 46*c* until the lower-bottom board outer portion 33 is brought into contact with the first inner portion 11 and the second inner portion 15 (until the lower-bottom board outer portion and the inner portions form an angle of about 90 degrees). The third strip segment 5 and the fourth strip segment 6 are folded on the fold lines 36*a* and 47*a*, the fold lines 36*b* and 47*b*, the fold lines 36*c* and 47*c*, and the fold lines 36*d* and 47*d* so as to surround the first strip segment 3. In the strip segments, two adjacent parts on both sides of the fold line (36*a* and 47*a* and others) form an angle of about 90 degrees, and the inner surface of the third strip segment 5 has face-to-face contact with the outer surface of the first strip segment 3.

A continuous edge 65 of the mutually merging first outer portion 31 and first buckling portion 41 and a continuous edge 66 of the mutually merging second outer portion 35 and second buckling portion 45 confront each other at a side opposite the side where the first inner portion 11 and the second inner portion 15 are connected together in a confronting state. The confronting edges 65 and 66 are connected together by an adhesive tape 67. Referring to FIGS. 4 and 6, the central buckling portion 43 is folded inwardly on the inclined fold lines 49*a* and 49*b*, and the first buckling portion 41 and the second buckling portion 45 connected together are folded inwardly on the inclined fold line 48 and the inclined fold line 59, respectively. This folding operation involves the folding of the corresponding portions on the fold lines 46*a*, 46*b*, 46*c*, 46*d*, and 46*e* and the fold lines 47*a*, 47*b*, 47*c*, and 47*d*.

The central buckling portion 43, the first buckling portion 41, and the second buckling portion 45 are folded up until two adjacent parts on both sides of the inclined fold line (49*a*, 49*b*, 48, and 59) overlap each other. When the central buckling portion 43, the first buckling portion 41, and the second buckling portion 45 are folded in that way, then the first buckling portion 41 and the central buckling portion 43 overlap the first lid portion 42 which is folded at the same time. The distance from the fold line 46*a* to an edge 71*a* of the first buckling portion 41, as well as the distance from the fold line 46*c* to an edge 71*c* of the central buckling portion 43, is smaller than the distance from the fold line 46*b* to an edge 71*b* of the first lid portion 42. That is, the first lid portion 42 has a single-ply area as a strip-like part 68 having a dimension of L as shown in FIG. 6. Likewise, the second lid portion 44 has a single-ply area as a strip-like part 69 having a dimension of L.

The first lid portion 42 and the second lid portion 44 are folded until they become substantially parallel with the upper-bottom board portion 23. The single-ply strip-like part 69 with the dimension L of the second lid portion 44 is inserted under the edge 71*b* of the first lid portion 42. The second lid portion 44 is held in place between the first lid portion 42 and the first buckling portion 41 as well as the central buckling portion 43. The region between the first lid portion 42 and the first buckling portion 41 as well as the central buckling portion 43 for securing the second lid portion 44 is made in a halftone area as shown in FIG. 6. Halftone areas in the first buckling portion 41 and the central buckling portion 43 as shown in FIG. 4 become involved in the formation of this region. The first recess 51 of the first buckling portion 41 and the second recess 53 of the central buckling portion 43 are provided to facilitate the insertion of the second lid portion 44 under the first lid portion 42.

The packing box 1 is built with use of the developed object 2 in the foregoing manner. For example, in contrast to a corrugated cardboard box of the A-type (orange carton type) which necessitates an adhesive tape for box sealing, the packing box 1 using the developed object 2 is sealed by inserting the second lid portion 44 under the first lid portion 42. Accordingly, no adhesive tape is required for box sealing, and re-sealing of the box can be made with ease. Moreover, the packing box 1 has its bottom composed of three layers, namely the lower-bottom board portion 22 acting as the lowermost layer which is continuous with both the lower-bottom board inner portion 13 and the lower-bottom board outer portion 33 that act as lateral surfaces (side walls), the middle-bottom board portion 21, and the upper-bottom board portion 23. Further, the quadruple lateral surface of the box is composed of two layers, namely the first strip segment 3 and the third strip segment 5. Accordingly, the packing box 1 has a strength high enough to accommodate cumbersome large-quantity metal components such as nails and bolts.

In the packing box 1, the taking-out opening 7 and the taking-out opening lid 8 can be formed to accommodate, for example, large-quantity nails and to take them out one by one or in small quantities on an as needed basis at a construction site and so forth. Referring to FIGS. 1, 6, and 7, the taking-out opening 7 and the taking-out opening lid 8 are formed by cutting the region inside the perforated cutting line for lid 55, and this cut part of the second lid portion 44 (the taking-out opening lid 8) is, only at the fold line 46*d*, continuous with the upper-bottom board outer portion 34 so as to be foldable on the fold line 46*d*. The taking-out opening lid 8 is formed with a concave finger-receiving part 74 which is created by cutting away the part surrounded by the concave line 58 (perforation). Two parts protruding on both sides of the concave finger-receiving part 74 will be termed a tab 75*a* and a tab 75*b*, respectively. It is noted that, in the packing box 1, the finger-receiving part 74 has a semicircular concavity formed at its inner edge for smooth insertion of fingers.

In the second lid portion 44, a substantially rectangular area which appears after the formation of the taking-out opening lid 8 by cutting constitutes the taking-out opening 7 when the taking-out opening lid 8 is opened while turning about the fold line 46*d* as an axis. In the course of building the developed object 2, when the central buckling portion 43 is folded on the fold line 49*b*, the square hole 54 becomes a notch having the shape of a right isosceles triangle so that the taking-out opening 7 can be opened widely. In order to close the taking-out opening 7 with the taking-out opening lid 8, the edge of the taking-out opening lid 8 is fitted in the edge of the taking-out opening 7, and then the tabs 75*a* and 75*b* are inserted under the strip-like part 68 of the first lid portion 42.

Moreover, the taking-out opening lid 8 is capable of closing the taking-out opening 7 in the following manner. The areas surrounded by the cutting lines 52*a* and 52*b*, respectively, in the first lid portion 42 are removed by cutting the perforation. Two rectangular recesses obtained by removing the areas surrounded by the cutting lines 52*a* and 52*b* will be termed a retaining portion 76*a* and a retaining portion 76*b*, respectively. In light of the positional relationship between the cutting line 52*a*, 52*b* and the end line 57 of the cutting line for lid 55 in the developed object 2, in the packing box 1, even if the retaining portions 76*a* and 76*b* are formed, the taking-out opening 7 can be closed with the taking-out opening lid 8 by inserting the tabs 75*a* and 75*b* under the strip-like part 68 of the first lid portion 42. However, considering the demand for one-hand closing operation, this closing method entails a slight difficulty.

In order to avoid this difficulty, the tab 75*a*, 75*b* is folded about 90 degrees so as to point inward when the taking-out opening lid 8 is closed (FIG. 7). In this way, when the taking-out opening 7 is closed with the taking-out opening lid 8, the tab 75*a*, 75*b* is fitted in the retaining portion 76*a*, 76*b*. Since a width W3 of the tab 75*a*, 75*b* is substantially the same as a width W4 of the retaining portion 76*a*, 76*b*, it never occurs that the tab 75*a*, 75*b* is disengaged from the retaining portion 76*a*, 76*b* easily. In consequence, the taking-out opening 7 can be maintained in a closed state.

The operation of closing the taking-out opening 7 with the taking-out opening lid 8 by engaging the tab 75*a*, 75*b* into the retaining portion 76*a*, 76*b* can be readily accomplished with only one hand.

As seen in a developed object 2B, the cutting line 52*a*, 52*b*, the square hole 54, and the cutting line for lid 55 that are formed in the first lid portion 42, the central buckling portion 43, and the second lid portion 44, respectively, may be provided in different positions from those in the developed object 2 so long as appropriate positional relations can be ensured among those portions. As a result, there is obtained a packing box 1B whose taking-out opening and taking-out opening lid are formed in different positions from those in the packing box 1.

Figure 8:
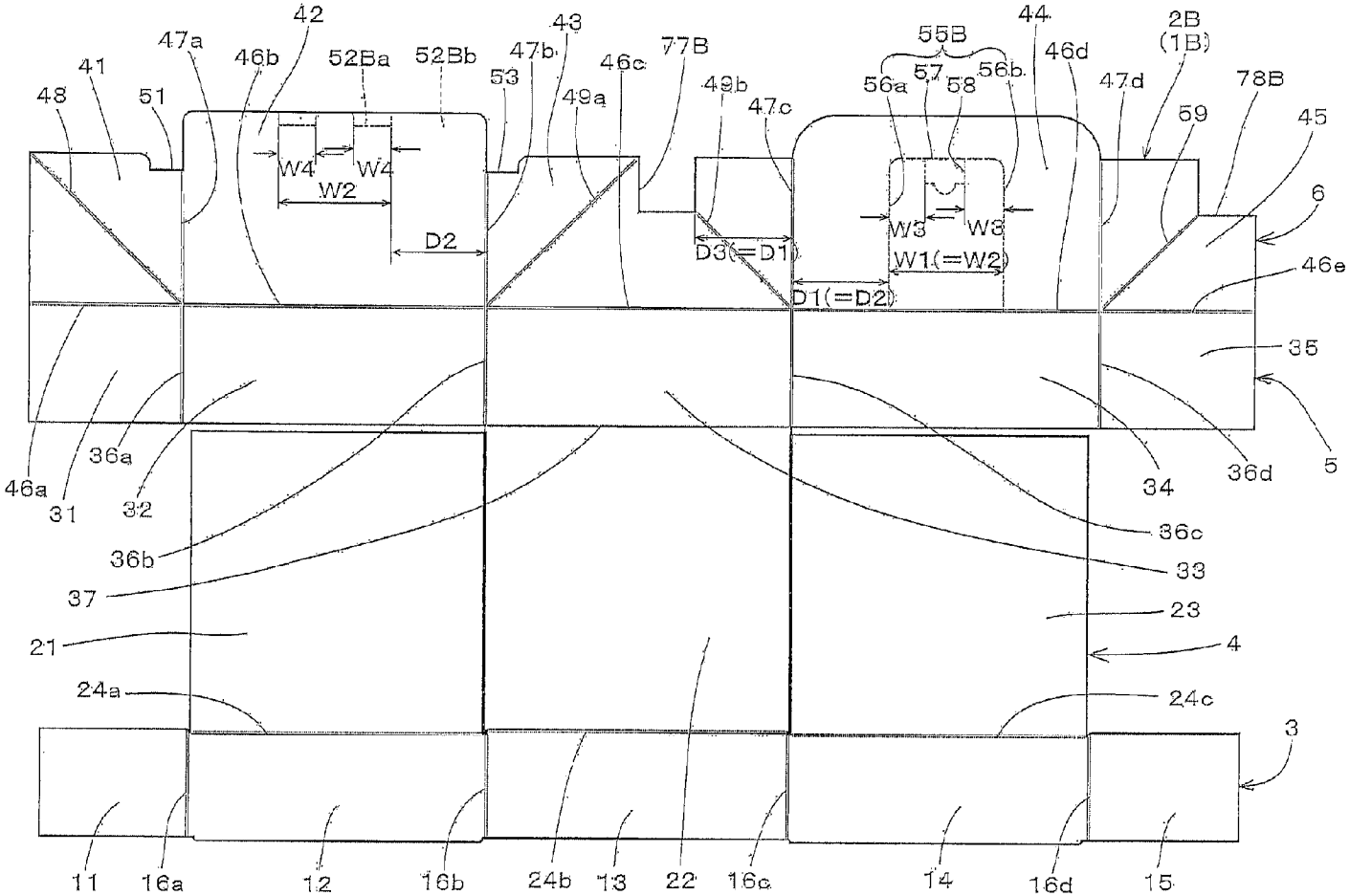
FIG. 8 is a developed view of another example of the packing box.

FIG. 8 is a developed view of the packing box 1B whose taking-out opening and taking-out opening lid are formed in a central area of the region defined by the first outer portion 31, the second outer portion 35, and the lower-bottom board outer portion 33 instead of the lower-bottom board outer portion 33-sided area thereof as shown in FIG. 7. In the developed object 2B of the packing box 1B, in order to form part of the taking-out opening, a substantially square-shaped cutaway 77B is formed in the central buckling portion 43, and a substantially square-shaped cutaway 78B is formed in the second buckling portion 45. A cutting line for lid 55B is located centrally of the second lid portion 44 in the lengthwise direction. A cutting line 52Ba and a cutting line 52Bb are located centrally of the first lid portion 42 in the lengthwise direction. Otherwise, the developed object of the packing box 1B is identical with the developed object 2 of the packing box 1, and therefore such constituent portions as are common to those in FIG. 1 will be identified with the same reference symbols and overlapping descriptions may be omitted.

It is noted that a spacing W1 between two side lines 56*a* and 56*b* in the cutting line for lid 55B is substantially the same as a dimension W2 which is the dimension of the region where the two cutting line 52Ba and 52Bb are formed in the first lid portion 42 in the lengthwise direction. Moreover, a distance D1 between the side line 56*a* located toward the central buckling portion 43 and the fold line 47*c* is substantially the same as a distance D2 between the cutting line 52Bb located toward the central buckling portion 43 and the fold line 47*b*. Further, the distance D1 is substantially the same as a distance D3 between the square hole 54 and the fold line 47*c*.

Distances W3, namely the distance W3 between the side line 56*a* and the area surrounded by the concave line 58 and the distance W3 between the sideline 56*b* and said surrounded area are substantially the same. The distances W3 are each substantially the same as a dimension W4 which is the dimension of the rectangle defined by the cutting line 52Ba, 52Bb in the lengthwise direction. The packing box 1B shown in FIG. 8 is illustrated by way of example for a case where the taking-out opening and the taking-out opening lid may be provided in any given locations. However, the packing box 1 having the taking-out opening and the taking-out opening lid formed at a corner of the top thereof (in the vicinity of a corner of the nearly square shape defining the top) has the advantage that, as the number of contents is decreased, box tilting can collect the contents in the corner of the packing box 1 with the result that the contents in large quantities can be taken out collectively at one time.

The four strip segments of the developed object 2, 2B of the packing box 1, 1B (the first to fourth strip segments 3 to 6) are illustrated as being board material portions extending in the lengthwise direction. However, in a case where the developed object 2, 2B of the packing box 1, 1B is configured to have a greater height (depth), the four strip segments may extend in the direction perpendicular to the lengthwise direction. This is because the width of the first strip segment 3, as well as the width of the third strip segment 5, is increased according to height.

Figure 9:
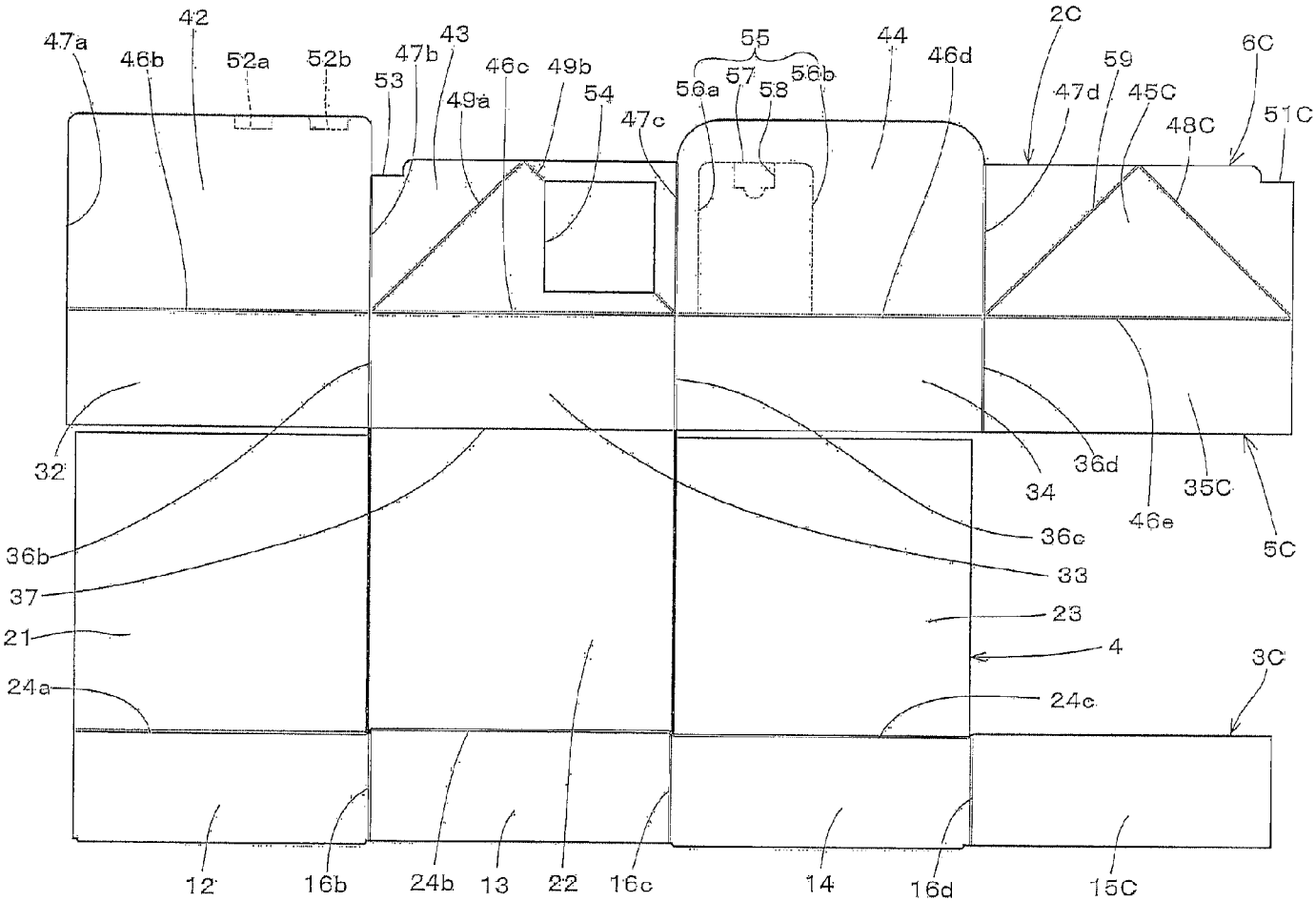
FIG. 9 is a developed view of showing another example of the packing box.

The packing box 1 can also be formed of a developed object 2C as shown in FIG. 9. The developed object 2C is devoid of the first inner portion 11, the first outer portion 31, and the first buckling portion 41 that are formed in the developed object 2, but in reality these portions are formed as integral parts of a second inner portion 15C, a second outer portion 35C, and a second buckling portion 45C, respectively. The second buckling portion 45C is formed with a first recess 51C and a fold line 48C that serve similarly to the first recess 51 and the fold line 48, respectively, of the developed object 2.

In FIG. 9, while the second outer portion 35C and the second buckling portion 45C that are continuous with each other via the fold line 46*e* are continuous with the second lid portion 44 and others, whereas the second inner portion 15C is continuous with the upper-bottom board inner portion 14, the portions 35C and 45C and/or the portion 15 may alternatively be made continuous with the first lid portion 42 and others and/or the middle-bottom board inner portion 12, respectively. In the developed object 2, 2B, 10 of the packing box 1, 1B, the distance D1 between the side line 56*a* located toward the central buckling portion 43 and the fold line 47*c* may be set to be smaller than the distance D3 between the square hole 54 and the fold line 47*c*. It is also possible to render the side line 56*a*, which is one of the side lines of the cutting line for lid 55, 55B, conform to the fold line 47*c*. In this case, the distance D1 becomes zero.

Modifications may be made in the packing box 1, 1B of the foregoing embodiments, and more specifically in the form of each constituent component, the entire configuration, and the shape, dimension, number, and material of each component within the spirit and scope of the present invention.

INDUSTRIAL APPLICABILITY

The present invention is applicable to a packing box for packaging a large quantity of articles such as nails and bolts.

EXPLANATION OF REFERENCE SYMBOLS

1, 1B Packing box
2, 2B, 2C Developed object
3 First strip segment (lowermost strip-like segment as viewed in FIG. 1)
4 Second strip segment
5 Third strip segment
6 Fourth strip segment
8 Taking-out opening lid (opening and closing lid)
11 First inner portion
12 Middle-bottom board inner portion
13 Lower-bottom board inner portion
14 Upper-bottom board inner portion
15, 15C Second inner portion
21 Middle-bottom board portion
22 Lower-bottom board portion
23 Upper-bottom board portion
31 First outer portion
32 Middle-bottom board outer portion
33 Lower-bottom board outer portion
34 Upper-bottom board outer portion
35, 35C Second outer portion
41 First buckling portion (terminal buckling portion)
42 First lid portion
43 Central buckling portion
44 Second lid portion
45, 45C Second buckling portion (terminal buckling portion)
48, 48C Fold line (fourth inclined fold line)
49*a* Fold line (first inclined fold line)
49*b* Fold line (second inclined fold line)
54 Square hole (hole)
55, 55B Cutting line for lid (perforation for lid)
59 Fold line (third inclined fold line)
77B Cutaway (for taking-out opening)
78B Cutaway (for taking-out opening) (terminal cutaway)

The invention claimed is:

1. A developed object for building a packing box, which is formed by processing a board material and comprises four segments extending in the same direction, namely a first strip segment, a second strip segment, a third strip segment, and a fourth strip segment, said first strip segment comprising: a middle-bottom board inner portion, a lower-bottom board inner portion, and an upper-bottom board inner portion that have substantially the same length in an extending direction in which the segment extends, and are continuous with one another via fold lines in said extending direction; and a first inner portion and a second inner portion that are continuous with said middle-bottom board inner portion and said upper-bottom board inner portion, respectively, at the outsides thereof via fold lines in said extending direction, the lengths of which being substantially the same as one-half of the length of said middle-bottom board inner portion in said extending direction, or a terminal inner portion which is continuous with one of said middle-bottom board inner portion and said upper-bottom board inner portion at the outside thereof via a fold line in said extending direction, the length of which being substantially the same as the length of said middle-bottom board inner portion in said extending direction, said second strip segment comprising three portions, namely a middle-bottom board portion, a lower-bottom board portion, and an upper-bottom board portion that are continuous with said middle-bottom board inner portion, said lower-bottom board inner portion, and said upper-bottom board inner portion, respectively, via fold lines conforming to their respective one sides in said extending direction, are each given substantially the shape of a square, one side of which conforming to the fold line, and are separated from one another at their sides other than the one sides conforming to the continuous fold lines, said third strip segment, which has substantially the same entire width as that of said first strip segment and is situated on an opposite side from said first strip segment with said second strip segment lying therebetween, comprising: a lower-bottom board outer portion which is continuous only with said lower-bottom board portion via a fold line; a middle-bottom board outer portion and an upper-bottom board outer portion that lie on both sides of said lower-bottom board outer portion in said extending direction, are each continuous with said lower-bottom board outer portion via a fold line, and have substantially the same length as that of said lower-bottom board outer portion in said extending direction; and a first outer portion and a second outer portion that are continuous with said middle-bottom board outer portion and said upper-bottom board outer portion, respectively, at the outsides thereof via fold lines in said extending direction, the lengths of which being substantially the same as one-half of the length of said middle-bottom board outer portion in said extending direction, or a terminal outer portion which is continuous with one of said middle-bottom board outer portion and said upper-bottom board outer portion at the outside thereof via a fold line in said extending direction, the length of which being substantially the same as the length of said middle-bottom board outer portion in said extending direction, said fourth strip segment, which is situated on an opposite side from said second strip segment with said third strip segment lying therebetween, comprising: a central buckling portion which is continuous with said lower-bottom board outer portion via a fold line, the width of which being substantially the same as one-half of one side of said lower-bottom board portion; a first lid portion and a second lid portion that lie on both sides of said central buckling portion in said extending direction, are each continuous with said central buckling portion via a fold line, are continuous with said middle-bottom board outer portion and said upper-bottom board outer portion, respectively, via fold lines, the widths of which being larger than or equal to one-half of one side of said lower-bottom board portion; and, where said third strip segment includes said first outer portion and second outer portion, a first buckling portion which is continuous with said first lid portion and said first outer portion via fold lines, the width of which being substantially the same as that of said central buckling portion and the length of which being substantially the same as that of said first outer portion in said extending direction, and a second buckling portion which is continuous with said second lid portion and said second outer portion via fold lines, the width of which being substantially the same as that of said central buckling portion and the length of which being substantially the same as that of said second outer portion in said extending direction, or, where said third strip segment includes said terminal outer portion, a terminal buckling portion which is continuous with said second lid portion and said terminal outer portion via fold lines, the width of which being substantially the same as that of said central buckling portion and the length of which being substantially the same as that of said terminal outer portion in said extending direction, said central buckling portion being formed with a first inclined fold line extending outwardly from a point of intersection of the fold lines merging with said first lid portion and said lower-bottom board outer portion, respectively, at an inclination angle of 45 degrees with respect to the fold lines, and a second inclined fold line extending outwardly from a point of intersection of the fold lines merging with said second lid portion and said lower-bottom board outer portion, respectively, at an inclination angle of 45 degrees with respect to the fold lines, said first buckling portion being formed with a fourth inclined fold line extending outwardly from a point of intersection of the fold lines merging with said first outer portion and said first lid portion, respectively, at an inclination angle of 45 degrees with respect to the fold lines, said second buckling portion being formed with a third inclined fold line extending outwardly from a point of intersection of the fold lines merging with said second outer portion and said second lid portion, respectively, at an inclination angle of 45 degrees with respect to the fold lines, said terminal buckling portion being formed with a third inclined fold line extending outwardly from a point of intersection of the fold lines merging with said terminal outer portion and said second lid portion, respectively, at an inclination angle of 45 degrees with respect to the fold lines, and a fourth inclined fold line which is orthogonal to said third inclined fold line at an edge of the terminal buckling portion opposite from the terminal outer portion-sided edge thereof, and extends therefrom toward said terminal outer portion, said central buckling portion being formed with a nearly-square hole or a nearly-square cutaway, a diagonal line of which conforming to said second inclined fold line, said second buckling portion having, where said cutaway is provided in said central buckling portion, a terminal cutaway formed at an outer edge thereof in said extending direction, a diagonal line of which conforming to said third inclined fold line, said second lid portion being formed with a cutting line for a lid for forming an opening and closing lid that overlaps to said hole or said cutaway when said second lid portion is folded over said central buckling portion on the fold line merging with said central buckling portion, said cutting line for a lid having two parallel side lines and an end line capable of being readily cut off by human hands, wherein said side lines extend in parallel with the fold line between said central buckling portion and said second lid portion as a starting point of a fold line between said second lid portion and said upper bottom board outer portion, and said end line establishes a connection between the extending ends of, respectively, said side lines, and wherein an area surrounded by said cutting line for a lid forming said opening and closing lid for opening and closing said packing box is the area the turning axis of which conforms to the fold line between said second lid portion and said upper bottom board outer portion by cutting both sides of said cutting line for a lid in said packing box.

2. A packing box formed by building the developed object as set forth in claim 1, comprising:

a nearly-square bottom formed of said middle-bottom board portion, said lower-bottom board portion, and said upper-bottom board portion of said second strip segment that are stacked on top of one another;

an inner lateral surface perpendicular to said bottom, which is formed of said first strip segment;

an outer lateral surface surrounding said inner lateral surface, which is formed of said third strip segment; and a top which is closed by folding said central buckling portion, said first lid portion, said second lid portion, said first buckling portion, and said second buckling portion of said fourth strip segment on their respective fold lines face to face with said bottom, and inserting an edge of said second lid portion opposite from the upper-bottom board outer portion-sided edge thereof under an edge of said first lid portion.

* * * * *